US006261756B1

(12) United States Patent
Biavasco et al.

(10) Patent No.: US 6,261,756 B1
(45) Date of Patent: Jul. 17, 2001

(54) LIGHT-SENSITIVE SILVER HALIDE COLOR PHOTOGRAPHIC ELEMENTS CONTAINING 2-EQUIVALENT 5-PYRAZOLONE MAGENTA COUPLER AND COLORED MAGENTA COUPLER

(75) Inventors: Raffaella Biavasco, Savona; Emilio Prosperi, Genova; Roberto Sardelli, Savona, all of (IT)

(73) Assignee: Terrania, S.p.A., Savona (IT)

( * ) Notice: Subject to any disclaimer, the term of this patent is extended or adjusted under 35 U.S.C. 154(b) by 0 days.

(21) Appl. No.: 09/576,529

(22) Filed: May 23, 2000

(30) Foreign Application Priority Data

May 25, 1999 (EP) ..... 99110140

(51) Int. Cl.[7] ..... G03C 1/08; G03C 7/26; G03C 7/32

(52) U.S. Cl. ..... 430/549; 430/555; 430/562; 430/505

(58) Field of Search ..... 430/543, 549, 430/555, 562, 505, 544

(56) References Cited

U.S. PATENT DOCUMENTS 4,070,191 * 1/1978 Imamura et al. ..... 430/562
5,663,040 * 9/1997 Bertoldi et al. ..... 430/555
5,965,341 * 2/2000 Merkel et al. ..... 430/549
6,020,115 * 2/2000 Orengo et al. ..... 430/555

FOREIGN PATENT DOCUMENTS 0651289 5/1995 (EP) .
0889358 1/1999 (EP) .
2226692 11/1974 (FR) .

* cited by examiner

*Primary Examiner*—Geraldine Letscher
(74) *Attorney, Agent, or Firm*—Mark A. Litman & Assoc.; Mark A. Litman

(57) ABSTRACT

The present invention refers to a light-sensitive silver halide multilayer color photographic element having a support base and coated thereon blue-, green- and red-sensitive silver halide emulsion layers respectively associated with non-diffusing yellow, magenta and cyan dye-forming couplers, wherein at least one green-sensitive layer contains a 2-equivalent 3-anilino-4-phenylthio-5-pyrazolone magenta coupler and a 4-(4-hydroxy-phenylazo)-5-pyrazolone colored magenta coupler.

The multilayer color photographic element of the present invention presents an improved speed and contrast, without a detrimental effect on the other sensitometric properties, such as Dmin and Dmax.

10 Claims, No Drawings

LIGHT-SENSITIVE SILVER HALIDE COLOR PHOTOGRAPHIC ELEMENTS CONTAINING 2-EQUIVALENT 5-PYRAZOLONE MAGENTA COUPLER AND COLORED MAGENTA COUPLER

FIELD OF THE INVENTION

The present invention relates to a light-sensitive silver halide multilayer color photographic element containing a 2-equivalent 5-pyrazolone magenta coupler and a 4-(4-hydroxy-phenylazo)-5-pyrazolone colored magenta coupler.

BACKGROUND OF THE INVENTION

It is known that color images may be obtained from imagewise exposed silver halide photographic elements by development with a primary aromatic amine color developing agent in the presence of a color coupler. The oxidized color developing agent formed in the areas of silver halide development couples with the coupler to form a dye. The coupler is normally incorporated in the sensitive photographic element.

It is also known that 5-pyrazolones in which the 4-position of the pyrazolone ring is free, that is having only hydrogen substituents (4-equivalent magenta couplers), can be used as magenta couplers in color photographic elements to provide magenta dye images having useful properties. Examples of such couplers are the 4-equivalents 3-anilino-5-pyrazolone couplers described in, for example, U.S. Pat. Nos. 3,519,429, 3,907,571, 3,928,044, 3,935,015 and 4,199,361. However, 4-equivalent 5-pyrazolone couplers have a number of disadvantages, as they require four equivalents of silver to produce each molecule of dye, are sensitive to certain chemical vapors, for example formaldehyde, and have poor dye light and dye dark stability. These drawbacks can be overcome by using so-called 2-equivalent 5-pyrazolone magenta couplers in which a substituent is introduced into the coupling position (4-position) of the coupler and eliminated as a leaving group (coupling-off group or splitting-off groups) during the color development process, thus requiring only two equivalent of silver in order to produce each molecule of dye.

Among coupling-off groups known in this connection are the arylthio groups described, for example, in U.S. Pat. Nos. 3,227,554, 3,701,783, 3,935,015, 4,351,897, 4,413,054, 4,556,630, 4,584,266, 4,740,438, 4,853,319, 4,876,182, 4,900,657, 4,929,540, 4,942,116, 5,250,407, 5,262,292, and 5,256,528; WO 88/04795, 92/18902, and 93/02393; EP 341,204, and GB 1,494,777.

2-equivalent 1-aryl-3-anilino-4-phenylthio-5-pyrazolone magenta couplers have been described, for example, in U.S. Pat. Nos. 4,413,054; 4,556,630; 4,584,266; 4,900,657; U.S. Pat. No. 5,256,528 and in GB 1,494,777 and in WO Patent Application 92/18902.

U.S. Pat. No. 5,663,040, discloses a silver halide photographic element comprising a support and at least one silver halide emulsion layer having a 2-equivalent 1-phenyl-3-anilino-4-phenylthio-5-pyrazolone magenta coupler, wherein both the 3-anilino and 4-phenylthio groups comprise a ballasting group, the 4-phenylthio group comprises a carbamoyl group being in 2-position with respect to the carbon atom attached to the sulfur atom and bearing said ballasting group, and the sum of sigma values of substituents on the 1-phenyl and the 3-anilino groups is less than 1.3.

In the subtractive color photography, blue sensitive, green sensitive and red sensitive layers are so constructed that yellow, magenta and cyan color images are formed, respectively. However, each of the dyes formed as color images has not always ideal absorption characteristics. For instance, the magenta dye image not only has a necessary green color absorption but also generally absorbs a blue color more or less, with the result that distortion is brought about in respect of color reproduction. In order to remove such distortion of color reproduction there are generally employed so called colored magenta couplers which exhibits a yellow color when they do not cause the coupling reaction as magenta couplers.

As such colored magenta couplers there have been known 4-arylazo-5-pyrazolones having at the 1- or 3-position a substituent containing a long-chain hydrocarbon group imparting a diffusion resistance to the couplers, such as disclosed in the specifications of U.S. Pat. Nos. 2,428,054; 2,449,966 and 2,455,170, 1-phenyl-4-arylazo-5-pyrazolones having at the 3-position a 2-halogeno-5-alkylamino-anilino or 2-halogeno-5-acylamino-anilino group, such as disclosed in Japanese Patent Publication No.15754/69, and the like.

However, 5-pyrazolones having an arylazo substituent at the 4-position have generally a lower rate of coupling with an oxidation product of a p-phenylene diamine derivative than 5-pyrazolones having no substituent at the 4-position, and therefore, in the case of 4-arylazo-5-pyrazolones it is difficult to obtain a sufficient photographic sensitivity and a sufficient dye density.

5-Pyrazolones having an anilino group at the 3-position have a very high coupling rate, and they are characterized in that their coupling rate, even in the case of 3-anilino-5-pyrazolones having an arylazo group introduced in the 4-position, is much higher than that of other 5-pyrazolones.

U.S. Pat. No. 4,070,191 discloses a 4-arylazo-5-pyrazolones colored magenta coupler which has a high coupling rate and gives a masked dye image having an absorption maximum wavelength in the blue ray region ranging from about 430 to about 460 m.mu.

U.S. Pat. No. 4,163,670 discloses a color photographic material containing a 5-pyrazolone derivative forming magenta dyestuff, in conjunction with red- and blue-sensitive emulsions containing phenol or a-naphthol and an open-chain ketomethylene compound forming blue and yellow dyestuffs respectively. The 5-pyrazolone magenta derivative has excellent spectral absorption characteristics and fastness and can be used in high temperature processing without fogging and desensitisation.

U.S. Pat. No. 5,853,971 discloses a color photographic material containing on a support at least one red-sensitive, green-sensitive and blue-sensitive silver halide emulsion layer together with interlayers between layers of different colour sensitivity, wherein at least one of the stated interlayers contains a masking coupler, the masking coupler having a defined reaction rate constant for the coupling reaction with the developer oxidation product, obtaining an improved sensitivity without increase of granularity.

U.S. Pat. No. 5,667,946 descibes a photographic silver halide emulsion layer having associated therewith a 1-(4-chlorophenyl)-3-(monosubstituted amino)-5-pyrazolone magenta coupler. Masked magenta coupler known in the art can be used in combination with such magenta couplers to give an improved spectral absorption curve.

U.S. Pat. No. 5,466,568 discloses a photographic element containing an azopyrazolone masking coupler and a ballasted aromatic nitro compound having a reduction peak potential which is more positive than −1.3 V vs. the Standard Calomel Electrode to exhibit reduced fog.

A problem of the photographic materials described in the art is the low speed and contrast obtained by the use of the magenta couplers and the colored magenta couplers used therein. An object of the present invention is to solve this problem, without a detrimental effect on the other sensitometric properties, such as Dmin and Dmax.

SUMMARY OF THE INVENTION

The present invention relates to a light-sensitive silver halide multilayer color photographic element having a support base and coated thereon blue-, green- and red-sensitive silver halide emulsion layers respectively associated with non-diffusing yellow, magenta and cyan dye-forming couplers, wherein at least one green-sensitive layer contains a 2-equivalent 5-pyrazolone magenta coupler and a 4-(4-hydroxy-phenylazo)-5-pyrazolone colored magenta coupler.

The silver halide photographic element of the present invention shows improved speed and contrast.

DETAILED DESCRIPTION OF THE INVENTION

As described above, the present invention relates to a light-sensitive silver halide multilayer color photographic element having a support base and coated thereon blue-, green- and red-sensitive silver halide emulsion layers respectively associated with non-diffusing yellow, magenta and cyan dye-forming couplers, wherein at least one green-sensitive layer contains a 2-equivalent 5-pyrazolone magenta coupler and a 4-(4-hydroxy-phenylazo)-5-pyrazolone colored magenta coupler.

The 2-equivalent 5-pyrazolone magenta coupler for use in the present invention is represented by the following formula (I)

(I)

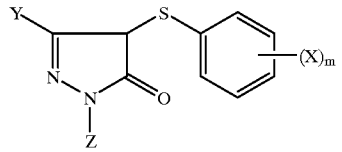

wherein Z represents a phenyl group substituted with one or more substituents selected from halogen atoms, alkyl groups, alkoxy groups, alkoxycarbonyl groups, or cyano groups, Y represents an anilino group, X represents hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, m represents an integer of from 1 to 5 and X may be the same or different when m is 2 or more.

Particularly preferred 2-equivalent 5-pyrazolone magenta couplers for use in the present invention are 1-phenyl-3-anilino-4-phenylthio-5-pyrazolone magenta coupler represented by the formula (II):

(II)

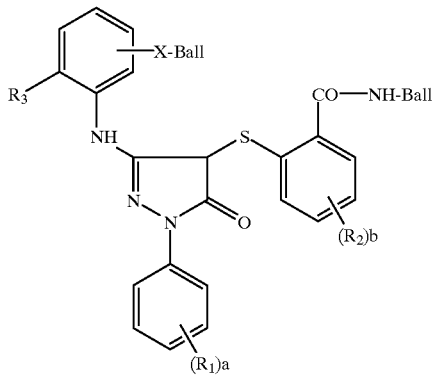

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl group or aryl group, X is a direct link or a linking group, and Ball is a ballasting group of such size and configuration as to render a group to which is attached non-diffusible in photographic coatings.

In the above formula, examples of $R_1$ and $R_2$ include hydrogen; alkyl group, including straight or branched chain alkyl group, such as alkyl group containing 1 to 8 carbon atoms, for example methyl, trifluoromethyl, ethyl, butyl, and octyl; alkoxy group, such as an alkoxy group having 1 to 8 carbon atoms, for example methoxy, ethoxy, propoxy, 2-methoxyethoxy, and 2-ethylhexyloxy; halogen, such as chlorine, bromine, and fluorine; aryl group, such as phenyl, naphthyl, and 4-tolyl; aryloxy group, such as phenoxy, p-methoxyphenoxy, p-methylphenoxy, naphthyloxy, and tolyloxy; acylamino group, such as acetamido, benzamido, butyramido, and t-butylcarbonamido; sulfonamido group, such as methylsulfonamido, benzenesulfonamido, and p-toluylsulfonamido; sulfamoyl group, such as N-methylsulfamoyl, N,N-diethylsulfamoyl, and N,N-dimethylsulfamoyl; carbamoyl group, such as N-methylcarbamoyl, and N,N-dimethylcarbamoyl; arylsulfonyl, such as tolylsulfonyl; aryloxycarbonyl group, such as phenoxycarbonyl; alkoxycarbonyl group, such as alkoxycarbonyl group containing 2 to 10 carbon atoms, for example methoxycarbonyl, ethoxycarbonyl, and benzyloxycarbonyl; alkoxysulfonyl group, such as alkoxysulfonyl group containing 2 to 10 carbon atoms, for example methoxysulfonyl, octyloxysulfonyl, and 2-ethylhexylsulfonyl; aryloxysulfonyl group, such as phenoxysulfonyl; alkylureido group, such as N-methylureido, N,N-dimethylureido, and N,N-dibutylureido; arylureido group, such as phenylureido; nitro, cyano, hydroxyl and carboxy group.

Examples of $R_3$ include halogen, such as chlorine, bromine, and fluorine; alkyl group, including straight or branched chain alkyl group, such as alkyl group containing 1 to 8 carbon atoms, for example methyl, trifluoromethyl, ethyl, butyl, and octyl; aryl group, such as phenyl, naphthyl, and 4-tolyl.

"Ball" is a ballasting group, i.e., an organic group of such size and configuration as to render a group to which is attached non-diffusible from the layer in which is coated in a photographic element. Said ballasting group includes an organic hydrophobic residue having 8 to 32 carbon atoms bonded to the coupler either directly or through a divalent linking group, such as an alkylene, imino, ether, thioether, carbonamido, sulfonamido, ureido, ester, imido, carbamoyl, and sulfamoyl group. Specific examples of suitable ballasting groups include alkyl groups (linear, branched, or cyclic), alkenyl groups, alkoxy groups, alkylaryl groups, alkylaryloxy groups, acylamidoalkyl groups, alkoxyalkyl groups, alkoxyaryl groups, alkyl groups substituted with an aryl group or a heterocyclic group, aryl groups substituted with an aryloxyalkoxycarbonyl group, and residues containing both an alkenyl or alkenyl long-chain aliphatic group and a carboxy or sulfo water-soluble group, as described, for example, in U.S. Pat. Nos. 3,337,344, 3,418,129, 3,892,572, 4,138,258, and 4,451,559, and in GB 1,494,777.

When the term "group" or "residue" is used in this invention to describe a chemical compound or substituent, the described chemical material includes the basic group or residue and that group or residue with conventional substitution. Where the term "moiety" is used to describe a chemical compound or substituent, only the unsubstituted chemical material is intended to be included. For example, "alkyl group" includes not only such alkyl moiety as methyl, ethyl, butyl, octyl, stearyl, etc., but also moieties bearing substituent groups such as halogen, cyano, hydroxyl, nitro, amino, carboxylate, etc. On the other hand, "alkyl moiety" includes only methyl, ethyl, stearyl, cyclohexyl, etc.

The sum of sigma values of substituents on the 1-phenyl and 3-anilino groups, such as $R_1$, $R_3$ and -X-Ball is preferably less than 1.3. The values of sigma constants can be easily found in the published literature (see, for example, "The Chemists° Companion", A. J. Gordon and R. A. Ford, John Wiley & Sons, New York, 1972, "Progress in Physical Organic Chemistry", V. 13, R. W. Taft, John Wiley & Sons, New York, "Substituents Constants for Correlation Analysis in Chemistry and Biology", C. Hansch and A. J. Leo, John Wiley & Sons, New York, 1979, and "Comprehensive Medicinal Chemistry", A. J. Leo, Pergamon Press, New York, V. 4, 1990), or can be calculated using the Medchem program (see "Comprehensive Medicinal Chemistry", A. J. Leo, Pergamon Press, New York, V. 4, 1990). Generally, sigma values increase with increasing electron withdrawing power of the substituent, with hydrogen=zero. For sigma values, only the atoms close to the phenyl ring have an electron withdrawing effect and remote atoms have no effect. Examples of sigma values for chemical groups or atoms are as follows: alkyl group=−0.17, chlorine atom=0.23, alkoxycarbonyl group=0.45, acylamino group=0.21, sulfamoyl group=0.57, alkylsulfonyl group=0.78, and carbamoyl=0.36.

Among the couplers described above, a preferred embodiment is represented by the above formula wherein the groups $R_1$ are chlorine atoms, a is 3, and the chlorine atoms are attached to the carbon atoms in position 2, 4 and 6 with respect to the carbon atom attached to the nitrogen atom.

A particularly preferred embodiment is represented by the above formula wherein the group $R_3$ is a chlorine atom.

Specific examples of 2-equivalent 1-phenyl-3-anilino-4-phenylthio-5-pyrazolone magenta couplers for use in the present invention are illustrated below, but the present invention should not be construed as being limited thereto.

I-1

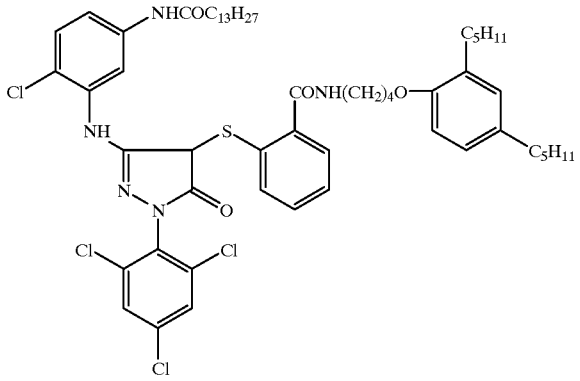

I-2

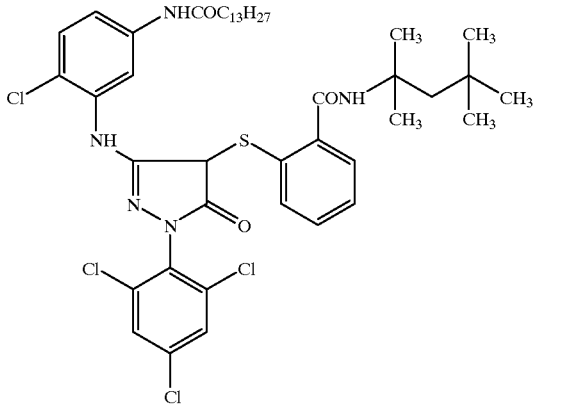

I-3

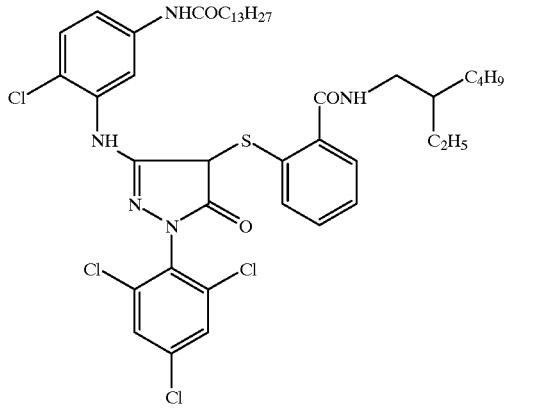

-continued
I-4
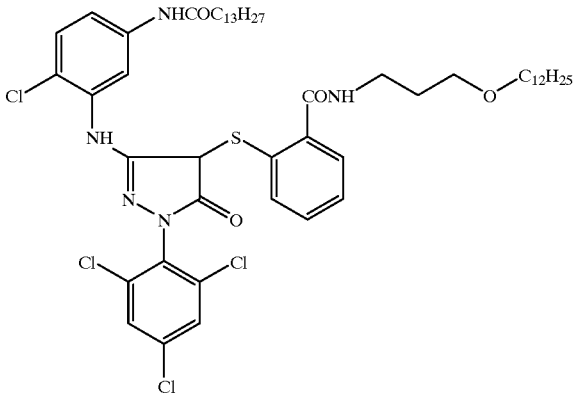
Other illustrative couplers include:
I-5
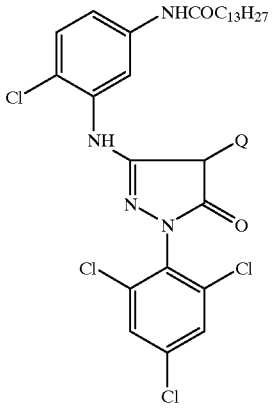
I-6
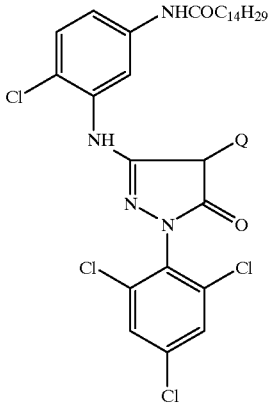
-continued
I-7
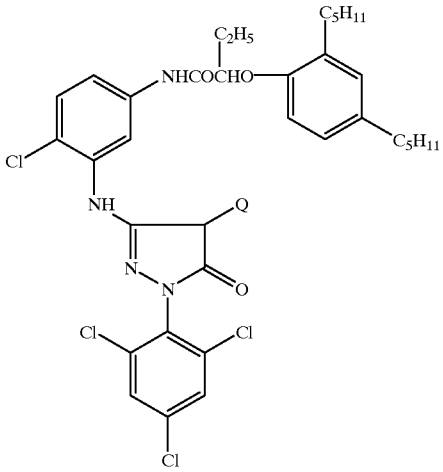
I-8
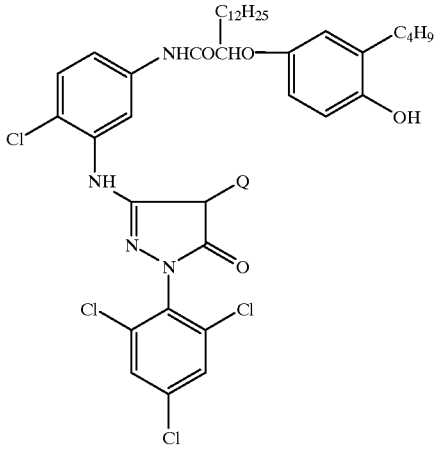
I-9
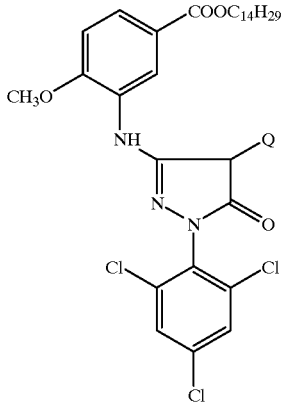
wherein Q represents a coupling-off group according to the invention.

Illustrative coupling-off groups Q are as follows:

Q-1

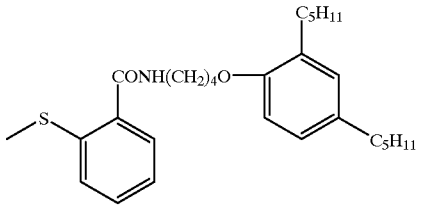

Q-2

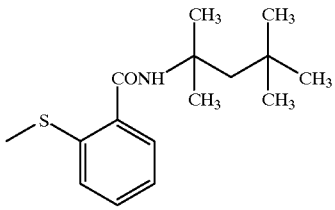

Q-3

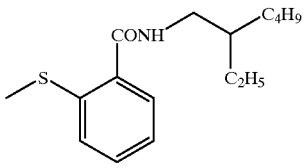

Q-4

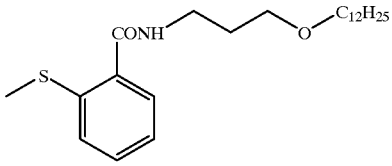

Q-5

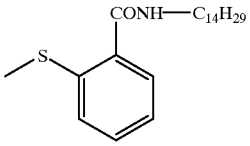

Q-6

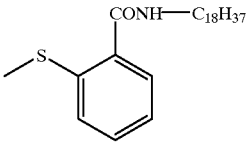

Q-7

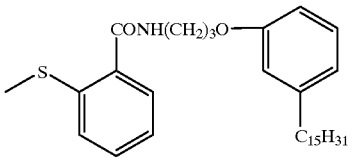

The synthesis of the couplers according to the invention can be prepared as described, for example, in U.S. Pat. No. 5,663,040.

The amount of the 2-equivalent 5-pyrazolone magenta couplers which can be used in the photographic element of the present invention can be varied depending upon the intended use of the photographic element, the structure of the coupler and the conditions of color processing. In general, the total amount of the 2-equivalent 5-pyrazolone magenta coupler in the photographic element can be varied from about 100 to about 1000 mg/m$^2$, preferably from about 250 to about 750 mg/m$^2$.

The colored magenta coupler for use in the present invention is represented by the following formula (III):

(III)

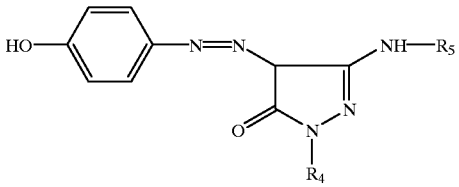

wherein $R_4$ represents an aryl group or a heterocyclic group, and $R_5$ represents a phenyl group.

According to a preferred embodiment, $R_4$ can be substituted with halogen atoms and cyano, nitro, alkyl, alkoxy, aryl, aryloxy, amido, carbamoyl, sulfonamido, sulfamoyl, amino, acyl, acyloxy, alkylthio, etc. groups. Examples of suitable aryl groups include a phenyl group, a 2-chlorophenyl group, a 4-chlorophenyl group, a 2,5-dichlorophenyl group, a 2,6-dichlorophenyl group, a 2,4,6-trichlorophenyl group, a 2-bromophenyl group, a 3,5-dibromophenyl group, a 2-cyanophenyl group, a 4-cyanophenyl group, a 3-nitrophenyl group, a 4-nitrophenyl group, a 4-tolyl group, a 2,6-dimethylphenyl group, a 2,6-diethylphenyl group, a 4-butylphenyl group, a 2-trifluoromethylphenyl group, a 2-ethoxyphenyl group, a 4-phenylphenyl group, a 4-phenoxyphenyl group, a N-methyl-benzamidophenyl group, a N,N-diphenylcarbamylphenyl group, a N,N-diphenylsulfamylphenyl group, a N,N-dibutylsulfamylphenyl group, a phenyl-N-methylsulfonamidophenyl group, a 2-methyl-5-nitrophenyl group, a 2-chloro-5-cyanophenyl group, a 5-chloro-2-methylphenyl group, a 2,6-dichloro-4-methylphenyl group, a 2,4-dichloro-6-methylphenyl group, a 2-chloro-4,6-dimethylphenyl group, a 2,6-dichloro-4-methoxyphenyl group, a 2,6-dichloro-4-nitrophenyl group, a 2,4,6-trimethyl-3-nitrophenyl group, a 2,4,6-trimethyl-3-substituted aminophenyl group, a 2,6-dichloro-4-acetylphenyl group, a 4-hexadecylcarbonyloxyphenyl group, a 2,6-dichloro-4-amylthiophenyl group, etc. Also, suitable examples of heterocyclic groups include 5- and 6-membered heterocyclic rings such as a 2-thiazolyl ring, a 2-benzothiazolyl ring, a 2-benzoxazolyl ring, a 2-oxazolyl ring, a 2-imidazolyl ring, a 2-benzimidazolyl ring, etc.

According to a preferred embodiment, $R_5$ has a halogen atom, an alkoxy group, or an aryloxy group at the ortho-position to the imino group bonded to the 3-position of the pyrazolone ring. $R_5$ may further be substituted with an alkyl group (such as a methyl group, a tert-butyl group, an octyl group, a dodecyl group, etc.); n aryl group (such as a phenyl group, a tolyl group, etc.); an alkoxy group (such s a methoxy group, an octoxy group); an aryloxy group (such as a phenoxy group, p-tert-butylphenoxy group, an naphthoxy group, etc. ); an alkylthio group (such as a methylthio group, an octylthio group, etc.); an arylthio group (such as a phenylthio group, etc.); an amino group (such as an amino group, a methylamino group, a diethylamino group, an anilino group, etc.); an amido group (such as an acetamido group, a butylamido group, a methylsulfonamido group, a diacylamido group, etc.); a sulfamoyl group (such as an N-sulfamoyl group, an N,N-diethylsulfamoyl group, an N-dodecylsulfamoyl group, an N-benzimidazolylsulfamoyl group, etc.); a carbamoyl group (such as a diethylcarbamoyl group, a tert-butylcarbamoyl group, an n-tetradecylcarbamoyl group, etc.); an alkoxycarbonyl group (such as a methoxycarbonyl group, a nonyloxycarbonyl group, a cyclohexyloxycarbonyl group, etc.); a halogen atom (such as a fluorine atom, a chlorine atom, a bromine atom, etc.); a hydroxyl group; a cyano group; or a nitro group. It is desired that the colored coupler represented by general formula (III) has at least one hydrophobic group having about 8 to 32 carbon atoms as a ballast group in the molecule thereof. The hydrophobic group facilitates the dissolution of the coupler in an organic solvent making it easy to disperse the coupler in a hydrophilic colloid and preventing the coupler from being crystallized to stabilize the color photographic material containing the colored coupler. If the number of carbon atoms of the hydrophobic group is less than about 8, the colored coupler is easily dissolved in a processing solution such as a developer and diffuses in photographic emulsion layers of the color photographic material, whereby the color reproduction is disturbed, while if the number of carbon atoms is larger than about 32, the interaction between coupler molecules becomes large and the coupler becomes only slightly soluble in organic solvents, which makes the use of such a colored coupler disadvantageous. Examples of such a hydrophobic group having about 8 to 32 carbon atoms are an alkyl group, an alkoxyalkyl group, an alkenyl group, an aryl group substituted with an alkyl group, an aryl group substituted with an alkoxy group, a terphenyl group, etc. These hydrophobic groups can be substituted with a halogen atom such as a fluorine atom or a chlorine atom, a nitro group, a cyano group, an alkoxycarbonyl group, an amide group, a carbonyl group, a sulfonamide group, etc. Specific examples of hydrophobic groups which can be employed in the present invention are a 2-ethylhexyl group, an n-octyl group, a tert-octyl group, an n-nonyl group, an n-decyl group, an n-dodecyl group, a 1,1-dimethyldecyl group, a 2,2-dimethyidecyl group, an n-hexadecyl group, a 2-(n-hexyl)-decyl group, an n-octadecyl group, a 9,10-dichlorooctadecyl group, a heptyloxyethyl group, a 2,4-di-tert-amyloxyethyl group, a dodecyloxypropyl group, an oleyl group, a 2,4-di-tert-butylphenyl group, a 2,4-di-tert-amylphenyl group, a 2,4-di-tert-amyl-6-chlorophenyl group, a 3-n-pentadecylphenyl group, a 2-dodecyloxyphenyl group, a 3-heptadecyloxyphenyl group, an o-terphenyl group, a perfluoroheptyl group, etc. The hydrophobic group can be combined with the coupler skeleton directly or through an imino-, ether-, carbonamido-, sulfonamido-, ureido-, ester-, imido-, carbamoyl- or sulfamoyl-bond.

Specific examples of colored magenta couplers for use in the present invention are illustrated below, but the present invention should not be construed as being limited thereto.

III-1

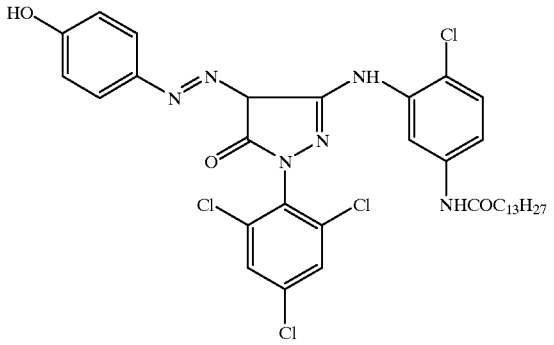

-continued

III-2

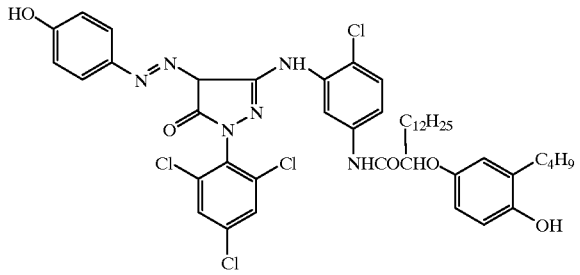

III-3

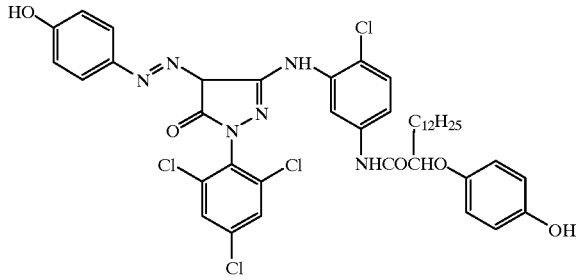

III-4

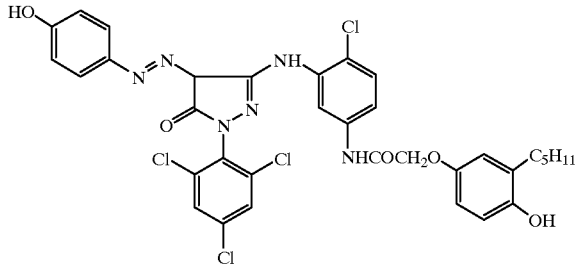

III-5

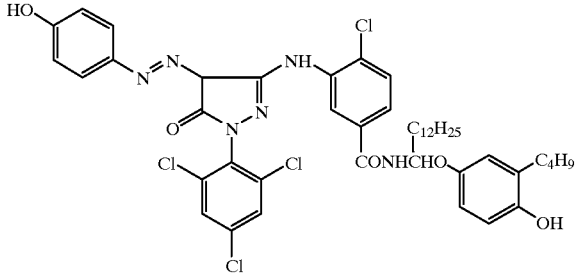

The synthesis of the colored magenta couplers according to the invention can be prepared as described, for example, in U.S. Pat. No. 4,070,191.

The amount of the colored magenta couplers which can be used in the photographic element of the present invention can be varied depending upon the intended use of the photographic element, the structure of the colored coupler and the conditions of color processing. In general, the total amount of the colored magenta coupler can be varied from about 10 to about 500 mg/m$^2$, preferably from about 50 to about 300 mg/m$^2$.

The multilayer silver halide color photographic elements of the present invention can be conventional photographic elements containing a silver halide as a light-sensitive substance.

The silver halides used in the multilayer color photographic elements of this invention may be a fine dispersion (emulsion) of silver chloride, silver bromide, silver chlorobromide, silver iodo-bromide and silver chloro-iodobromide grains in a hydrophilic binder. Preferred silver halides are silver iodo-bromide or silver iodo-bromo-chloride containing 1 to 20% mole silver iodide. In silver iodo-bromide emulsions or silver iodo-bromo-chloride, the iodide can be uniformly distributed among the emulsion grains, or iodide level can varied among the grains. The silver halides can have a uniform grain size or a broad grain size distribution. The silver halide grains may be regular grains having a regular crystal structure such as cubic, octahedral, and tetradecahedral, or the spherical or irregular crystal structure, or those having crystal defects such as twin plane, or those having a tabular form, or the combination thereof.

The term "cubic grains" is intended to include substantially cubic grains, that is grains which are regular cubic grains bounded by crystallographic faces (100), or which may have rounded edges and/or vertices or small faces (111), or may even be nearly spherical when prepared in the presence of soluble iodides or strong ripening agents, such as ammonia. Particularly good results are obtained with silver halide grains having average grain sizes in the range from 0.2 to 3 $\mu$m, more preferably from 0.4 to 1.5 $\mu$m. Preparation of silver halide emulsions comprising cubic silver iodobromide grains is described, for example, in Research Disclosure, Vol. 184, Item 18431, Vol.176, Item 17644 and Vol. 308, Item 308119.

Other silver halide emulsions are those which employ one or more light-sensitive tabular grain emulsions. The tabular silver halide grains have an average diameter:thickness ratio (often referred to in the art as aspect ratio) of at least 2:1, preferably 2:1 to 20:1, more preferably 3:1 to 14:1, and most preferably 3:1 to 8:1. Average diameters of the tabular silver halide grains range from about 0.3 $\mu$m to about 5 $\mu$m, preferably 0.5 $\mu$m to 3 $\mu$m, more preferably 0.8 $\mu$m to 1.5 $\mu$m. The tabular silver halide grains have a thickness of less than 0.4 $\mu$m, preferably less than 0.3 $\mu$m and more preferably less than 0.2 $\mu$m.

The tabular grain characteristics described above can be readily ascertained by procedures well known to those skilled in the art. The term "diameter" is defined as the diameter of a circle having an area equal to the projected area of the grain. The term "thickness" means the distance between two substantially parallel main planes constituting the tabular silver halide grains. From the measure of diameter and thickness of each grain the diameter:thickness ratio of each grain can be calculated, and the diameter:thickness ratios of all tabular grains can be averaged to obtain their average diameter:thickness ratio. By this definition, the average diameter:thickness ratio is the average of individual tabular grain diameter:thickness ratios. In practice, it is simpler to obtain an average diameter and an average thickness of the tabular grains and to calculate the average diameter:thickness ratio as the ratio of these two averages. Whatever the used method may be, the average diameter:thickness ratios obtained do not greatly differ.

In the silver halide emulsion layer containing tabular silver halide grains, at least 15%, preferably at least 25%, and, more preferably, at least 50% of the silver halide grains are tabular grains having an average diameter:thickness ratio of not less than 2:1. Each of the above proportions, "15%", "25%" and "50%" means the proportion of the total projected area of the tabular grains having a diameter:thickness ratio of at least 2:1 and a thickness lower than 0.4 $\mu$m, as compared to the projected area of all of the silver halide grains in the layer.

It is known that photosensitive silver halide emulsions can be formed by precipitating silver halide grains in an aqueous dispersing medium comprising a binder, gelatin preferably being used as a binder.

The silver halide grains may be precipitated by a variety of conventional techniques. The silver halide emulsion can be prepared using a single-jet method, a double-jet method, or a combination of these methods or can be matured using, for instance, an ammonia method, a neutralization method, an acid method, or can be performed an accelerated or constant flow rate precipitation, interrupted precipitation, ultrafiltration during precipitation, etc. References can be found in Trivelli and Smith, The Photographic Journal, Vol. LXXIX, May 1939, pp. 330–338, T. H. James, The Theory of The Photographic Process, 4th Edition, Chapter 3, U.S. Pat. Nos. 2,222,264, 3,650,757, 3,917,485, 3,790,387, 3,716,276, and 3,979,213, Research Disclosure, Dec. 1989, Item 308119 "Photographic Silver Halide Emulsions, Preparations, Addenda, Processing and Systems", and Research Disclosure, September 1976, Item 14987.

One common technique is a batch process commonly referred to as the double-jet precipitation process by which a silver salt solution in water and a halide salt solution in water are concurrently added into a reaction vessel containing the dispersing medium.

In the double jet method, in which alkaline halide solution and silver nitrate solution are concurrently added in the gelatin solution, the shape and size of the formed silver halide grains can be controlled by the kind and concentration of the solvent existing in the gelatin solution and by the addition speed. Double-jet precipitation processes are described, for example, in GB 1,027,146, and 1,302,405, U.S. Pat. Nos. 3,801,326, 4,046,376, 3,790,386, 3,897,935, 4,147,551, and 4,171,224.

The single jet method in which a silver nitrate solution is added in a halide and gelatin solution has been long used for manufacturing photographic emulsion. In this method, because the varying concentration of halides in the solution determines which silver halide grains are formed, the formed silver halide grains are a mixture of different kinds of shapes and sizes.

Precipitation of silver halide grains usually occurs in two distinct stages. In a first stage, nucleation, formation of fine silver halide grain occurs. This is followed by a second stage, the growth stage, in which additional silver halide formed as a reaction product precipitates onto the initially formed silver halide grains, resulting in a growth of these silver halide grains. Batch double-jet precipitation processes are typically undertaken under conditions of rapid stirring of reactants in which the volume within the reaction vessel continuously increases during silver halide precipitation and soluble salts are formed in addition to the silver halide grains.

In order to avoid soluble salts in the emulsion layers of a photographic material from crystallizing out after coating and other photographic or mechanical disadvantages (stickiness, brittleness, etc.), the soluble salts formed during precipitation have to be removed.

In preparing the silver halide emulsions, a wide variety of hydrophilic dispersing agents for the silver halides can be employed. As hydrophilic dispersing agent, any hydrophilic polymer conventionally used in photography can be advantageously employed including gelatin, a gelatin derivative such as acylated gelatin, graft gelatin, etc., albumin, gum arabic, agar agar, a cellulose derivative, such as hydroxyethylcellulose, carboxymethylcellulose, etc., a synthetic resin, such as polyvinyl alcohol, polyvinylpyrrolidone, poly-acrylamide, etc. Other hydrophilic materials useful known in the art are described, for example, in Research Disclosure, Vol. 308, Item 308119, Section IX.

The silver halide grain emulsion can be chemically sensitized using sensitizing agents known in the art. Sulfur containing compounds, gold and noble metal compounds, and polyoxyalkylene compounds are particularly suitable. In particular, the silver halide emulsions may be chemically sensitized with a sulfur sensitizer, such as sodium thiosulfate, allylthiocyanate, allylthiourea, thiosulfinic acid and its sodium salt, sulfonic acid and its sodium salt, allylthiocarbamide, thiourea, cystine, etc.; an active or inert selenium sensitizer; a reducing sensitizer such as stannous salt, a polyamine, etc.; a noble metal sensitizer, such as gold sensitizer, more specifically potassium aurithiocyanate, potassium chloroaurate, etc.; or a sensitizer of a water soluble salt such as for instance of ruthenium, rhodium, iridium and the like, more specifically, ammonium chloropalladate, potassium chloroplatinate and sodium chloropalladite, etc.; each being employed either alone or in a suitable combination. Other useful examples of chemical sensitizers are described, for example, in Research Disclosure 17643, Section III, 1978 and in Research Disclosure 308119, Section III, 1989.

The silver halide emulsion can be spectrally sensitized with dyes from a variety of classes, including the polymethyne dye class, which includes the cyanines, merocyanines, complex cyanines and merocyanines, oxonols, hemioxonols, styryls, merostyryls, and streptocyanine.

The cyanine spectral sensitizing dyes include, joined by a methine linkage, two basic heterocyclic nuclei, such as those derived from quinoline, pyrimidine, isoquinoline, indole, benzindole, oxazole, thiazole, selenazole, imidazole, benzoxazole, benzothiazole, benzoselenazole, benzoimidazole, naphthoxazole, naphthothiazole, naphthoselenazole, tellurazole, oxatellurazole.

The merocyanine spectral sensitizing dyes include, joined by a methine linkage, a basic heterocyclic nucleus of the cyanine-dye type and an acidic nucleus, which can be derived from barbituric acid, 2-thiobarbituric acid, rhodanine, hydantoin, 2-thiohydantoin, 2-pyrazolin-5-one, 2-isoxazolin-5-one, indan-1,3-dione, cyclohexane-1,3-dione, 1,3-dioxane-4,6-dione, pyrazolin-3,5-dione, pentane-2,4-dione, alkylsulfonylacetonitrile, malononitrile, isoquinolin-4-one, chromane-2,4-dione, and the like.

One or more spectral sensitizing dyes may be used. Dyes with sensitizing maxima at wavelengths throughout the visible and infrared spectrum and with a great variety of spectral sensitivity curve shapes are known. The choice and relative proportion of dyes depends on the region of the spectrum to which sensitivity is desired and on the shape of the spectral sensitivity desired.

Examples of sensitizing dyes can be found in Venkataraman, *The chemistry of Synthetic Dyes*, Academic Press, New York, 1971, Chapter V, James, *The Theory of the Photographic Process,* 4th Ed., Macmillan, !977, Chapter 8, F. M. Hamer, *Cyanine Dyes and Related Compounds*, John Wiley and Sons, 1964, and in Research Disclosure 308119, Section III,1989.

The silver halide emulsions can contain optical brighteners, antifogging agents and stabilizers, filtering and antihalo dyes, hardeners, coating aids, plasticizers and lubricants and other auxiliary substances, as for instance described in Research Disclosure 17643, Sections V, VI, VIII, X, XI and XII, 1978, and in Research Disclosure 308119, Sections V, VI, VIII, X, XI, and XII, 1989.

Silver halide multilayer color photographic elements according to the present invention comprise, coated on a support, a red-sensitive silver halide emulsion layer associated with cyan dye-forming color couplers, a green-sensitive silver halide emulsion layer associated with magenta dye-forming color couplers and a blue-sensitive silver halide emulsion layer associated with yellow dye-forming color couplers. Preferably, each red-, green- and blue-sensitive layer is usually comprised of multiple (two or more) emulsion sub-layers sensitive to a given region of visible spectrum. When multilayer materials contain multiple blue, green or red sub-layers, these can be in any case relatively faster and relatively slower sub-layers. At least one of the green-sensitive sub-layers contains at least a 2-equivalent 5-pyrazolone magenta dye-forming coupler and at least a 4-(4-hydroxy-phenylazo)-5-pyrazolone colored magenta coupler described above; preferably all the green-sensitive sub-layers contain said magenta dye-forming couplers and said colored magenta couplers described above. These elements additionally comprise other non-light sensitive layers, such as intermediate layers, filter layers, antihalation layers and protective layers, thus forming a multilayer structure. These color photographic elements, after imagewise exposure to actinic radiation, are processed in a chromogenic developer to yield a visible color image. The layer units can be coated in a layer arrangement comprising the red-sensitive layers coated nearest the support and overcoated by the green-sensitive layers, a yellow filter layer and the blue-sensitive layers.

In addition to the couplers described above, the silver halide photographic element of the invention can contain other suitable color couplers. Suitable color couplers are preferably selected from the couplers having diffusion preventing groups, such as groups having a hydrophobic organic residue of about 8 to 32 carbon atoms, introduced into the coupler molecule in a non-splitting-off position. Such a residue is called a "ballast group". The ballast group is bonded to the coupler nucleus directly or through an imino, ether, carbonamido, sulfonamido, ureido, ester, imido, carbamoyl, sulfamoyl bond, etc. Examples of suitable ballasting groups are described in U.S. Pat. No. 3,892,572.

Said non-diffusible couplers are introduced into the light-sensitive silver halide emulsion layers or into non-light-sensitive layers adjacent thereto. On exposure and color development, said couplers give a color which is complementary to the light color to which the silver halide emulsion layers are sensitive. Consequently, at least one non-diffusible cyan-image forming color coupler, generally a phenol or an a-naphthol compound, is associated with red-sensitive silver halide emulsion layers, at least one non-diffusible magenta image-forming color coupler, such as the 1-phenyl-3-anilino-4-phenylthio-5-pyrazolone described above, is associated with green-sensitive silver halide emulsion layers and at least one non-diffusible yellow image forming color coupler, generally an acylacetanilide compound, is associated with blue-sensitive silver halide emulsion layers.

Said color couplers may be 4-equivalent and/or 2-equivalent couplers, the latter requiring a smaller amount of silver halide for color production. As it is well known, as described above, 2-equivalent couplers derive from 4-equivalent couplers since, in the coupling position, they contain a substituent which is released during coupling reaction. 2-equivalent couplers which may be used in silver halide color photographic elements include both those substantially colorless and those which are colored ("masking couplers"). The 2-equivalent couplers also include white couplers which do not form any dye on reaction with the color developer oxidation products. The 2-equivalent color couplers include also DIR couplers which are capable of releasing a diffusing development inhibiting compound on reaction with the color developer oxidation products.

The most useful cyan-forming couplers are conventional phenol compounds and a-naphthol compounds. Examples of cyan couplers can be selected from those described in U.S. Pat. Nos. 2,369,929; 2,474,293; 3,591,383; 2,895,826; 3,458,315; 3,311,476; 3,419,390; 3,476,563 and 3,253,924; in GB 1,201,110, and in Research Disclosure 308119, Section VII, 1989.

The most useful magenta-forming couplers are those described above.

The most useful yellow-forming couplers are conventional open-chain ketomethylene type couplers. Particular examples of such couplers are benzoyl acetanilide type and pivaloyl acetanilide type compounds. Yellow-forming couplers that can be used are specifically described in U.S. Pat. Nos. 2,875,057, 3,235,924, 3,265,506, 3,278,658, 3,369,859, 3,408,194, 3,415,652 3,528,322, 3,551,151, 3,682,322, 3,725,072 and 3,891,445, in DE 2,219,917, 2,261,361 and 2,414,006, in GB 1,425,020, in JP 10,783/76, 26,133/72, 73,147/73, 102,636/76, 6,341/75, 123,342/75, 130,442/75, 1,827/76, 87,650/75, 82,424/77 and 115,219/77, and in Research Disclosure 308119, Section VII, 1989.

In addition to the colored magenta couplers described above, other suitable color couplers can be used which include those described for example in U.S. Pat. Nos. 3,476,560, 2,521,908 and 3,034,892, in JP 2,016/69, 22,335/63, 11,304/67, 32,461/69, 26,034/76 and 42,121/77 and in DE 2,418,959. The light-sensitive silver halide color photographic element may contain high molecular weight color couplers as described for example in U.S. Pat. No. 4,080,211, in EP 27,284 and in DE 1,297,417, 2,407,569, 3,148,125, 3,217,200, 3,320,079, 3,324,932, 3,331,743, and 3,340,376, and in Research Disclosure 308119, Section VII, 1989.

Colored cyan couplers can be selected from those described in U.S. Pat. Nos. 3,934,802; 3,386,301 and 2,434,272, while the most useful colored magenta couplers are those exemplified above. Colorless couplers can be selected from those described in GB 861,138; 914,145 and 1,109,963 and in U.S. Pat. No. 3,580,722 and in Research Disclosure 308119, Section VII, 1989.

Also, couplers providing diffusible colored dyes can be used together with the above mentioned couplers for improving graininess and specific examples of these couplers are magenta couplers described in U.S. Pat. No. 4,366,237 and GB 2,125,570 and yellow, magenta and cyan couplers described in EP 96,873, in DE 3,324,533 and in Research Disclosure 308119, Section VII, 1989.

Also, among the 2-equivalent couplers are those couplers which carry in the coupling position a group which is released in the color development reaction to give a certain photographic activity, e.g. as development inhibitor or accelerator, either directly or after removal of one or further groups from the group originally released. Examples of such 2-equivalent couplers include the known DIR couplers as well as DAR and FAR couplers. Typical examples of said couplers are described in DE 2,703,145, 2,855,697, 3,105,026, 3,319,428, 1,800,420, 2,015,867, 2,414,006, 2,842,063, 3,427,235, 3,209,110, and 1,547,640, in GB 953,454 and 1,591,641, in EP 89,843, 117,511, 118,087, and 301,477 and in Research Disclosure 308119, Section VII, 1989.

Examples of non-color forming DIR coupling compounds which can be used in silver halide color elements include those described in U.S. Pat. Nos. 3,938,996; 3,632,345; 3,639,417; 3,297,445 and 3,928,041; in German 2,405,442; 2,523,705; 2,460,202; 2,529,350 and 2,448,063; in Japanese 143,538/75 and 147,716/75, in GB 1,423,588 and 1,542,705 and 301,477 and in Research Disclosure 308119, Section VII, 1989.

In order to introduce the couplers into the silver halide emulsion layer, some conventional methods known to the skilled in the art can be employed. According to U.S. Pat. Nos. 2,322,027, 2,801,170, 2,801,171 and 2,991,177, the couplers can be incorporated into the silver halide emulsion layer by the dispersion technique, which consists of dissolving the coupler in a water-immiscible high-boiling organic solvent and then dispersing such a solution in a hydrophilic colloidal binder under the form of very small droplets. The preferred colloidal binder is gelatin, even if some other kinds of binders can be used.

Another type of introduction of the couplers into the silver halide emulsion layer consists of the so-called "loaded-latex technique". A detailed description of such technique can be found in BE 853,512 and 869,816, in U.S. Pat. Nos. 4,214,047 and 4,199,363 and in EP 14,921. It consists of mixing a solution of the couplers in a water-miscible organic solvent with a polymeric latex consisting of water as a continuous phase and of polymeric particles having a mean diameter ranging from 0.02 to 0.2 micrometers as a dispersed phase.

Another useful method is further the Fisher process. According to such a process, couplers having a water-soluble group, such as a carboxyl group, a hydroxy group, a sulfonic group or a sulfonamido group, can be added to the photographic layer for example by dissolving them in an alkaline water solution.

Useful methods of introduction of couplers into silver halide emulsions are described in Research Disclosure 308119, Section VII, 1989.

The layers of the photographic elements can be coated on a variety of supports, such as cellulose esters supports (e.g., cellulose triacetate supports), paper supports, polyesters film supports (e.g., polyethylene terephthalate film supports or polyethylene naphthalate film supports), and the like, as described in Research Disclosure 308119, Section XVII, 1989.

The photographic elements according to this invention, may be processed after exposure to form a visible image upon association of the silver halides with an alkaline aqueous medium in the presence of a developing agent contained in the medium or in the material, as known in the art. The aromatic primary amine color developing agent used in the photographic color developing composition can be any of known compounds of the class of p-phenylenediamine derivatives, widely employed in various color photographic process. Particularly useful color developing agents are the p-phenylendiamine derivatives, especially the N,N-dialkyl-p-phenylenediamine derivatives wherein the alkyl groups or the aromatic nucleus can be substituted or not substituted.

Examples of p-phenylenediamine developers include the salts of: N,N-diethyl-p-phenylenediamine, 2-amino-5-diethylamino-toluene, 4-amino-N-ethyl-N-(α-methanesulphonamidoethyl)-m-toluidine, 4-amino-3-methyl-N-ethyl-N-(α-hydroxy-ethyl)-aniline, 4-amino-3-(α-methylsulfonamidoethyl)-N,N-diethylaniline, 4-amino-N,N-diethyl-3-(N'-methyl-α-methylsulfonamido)-aniline, N-ethyl-N-methoxy-ethyl-3-methyl-p-phenylenediamine and the like, as described, for instance, in U.S. Pat. Nos. 2,552,241; 2,556,271; 3,656,950 and 3,658,525.

Examples of commonly used developing agents of the p-phenylene diamine salt type are: 2-amino-5-diethylaminotoluene hydrochloride (generally known as CD2 and used in the developing solutions for color positive photographic material), 4-amino-N-ethyl-N-(α-methanesulfonamidoethyl)-m-toluidine sesquisulfate monohydrate (generally known as CD3 and used in the developing solution for photographic papers and color reversal materials) and 4-amino-3-methyl-N-ethyl-N-(p-hydroxyethyl)-aniline sulfate (generally known as CD4 and used in the developing solutions for color negative photographic materials).

Said color developing agents are generally used in a quantity from about 0.001 to about 0.1 moles per liter, preferably from about 0.0045 to about 0.04 moles per liter of photographic color developing compositions.

In the case of color photographic materials, the processing comprises at least a color developing bath and, optionally, a prehardening bath, a neutralizing bath, a first (black and white) developing bath, etc. These baths are well known in the art and are described for instance in Research Disclosure 17643, 1978, and in Research Disclosure 308119, Sections XIX and XX, 1989.

After color development, the image-wise developed metallic silver and the remaining silver salts generally must be removed from the photographic element. This is performed in separate bleaching and fixing baths or in a single bath, called blix, which bleaches and fixes the image in a single step. The bleaching bath is a water solution having a pH equal to 5.60 and containing an oxidizing agent, normally a complex salt of an alkali metal or of ammonium and of trivalent iron with an organic acid, e.g., EDTA.Fe.NH4, wherein EDTA is the ethylenediaminotetracetic acid, or PDTA.Fe.NH4, wherein PDTA is the propylenediaminotetraacetic acid. While processing, this bath is continuously aired to oxidize the divalent iron which forms while bleaching the silver image and regenerated, as known in the art, to maintain the bleach effectiveness. The bad working of these operations may cause the drawback of the loss of cyan density of the dyes.

Further to the above mentioned oxidizing agents, the blix bath can contain known fixing agents, such as for example ammonium or alkali metal thiosulfates. Both bleaching and fixing baths can contain other additives, e.g., polyalkyleneoxide compounds, as described for example in GB patent 933,008 in order to increase the effectiveness of the bath, or thioether compounds known as bleach accelerators.

The present invention will be illustrated with reference to the following examples, but it should be understood that these examples do not limit the present invention.

EXAMPLE 1

A multilayer color photographic element (Sample 101, comparison example) was prepared by coating layers of the hereinafter reported composition onto a transparent cellulose acetate film support provided with a gelatin underlayer. In the hereinafter reported compositions, the coating quantity of silver halides (expressed as silver-equivalent), gelatin and other additions are reported in grains per square meter ($g/m^2$). All silver halide emulsions were stabilized with 4-hydroxy-6-methyl-1,3,3a,7-tetrazaindene and spectrally sensitized with suitable sensitizing dyes for the red, green and blue light of the spectrum.

| | |
|---|---|
| Layer 1 (Antihalo Layer) | |
| Black colloidal silver | 0.19 |
| Gelatin | 1.29 |
| Dye 1 | 0.007 |
| Dye 2 | 0.076 |
| Magenta Masked Coupler MM-1 | 0.033 |
| Layer 2 (Interlayer) | |
| Gelatin | 1.160 |
| UV-1 | 0.054 |
| UV-2 | 0.054 |
| Compound 1 | 0.020 |
| Layer 3 (Red-Sensitive Low Sensitivity Layer) | |
| Silver iodobromide emulsion A (AgI 2.5% moles, average diameter 0.4 $\mu$m) | 0.490 |
| Gelatin | 1.240 |
| Cyan Coupler C-1 | 0.201 |
| Cyan Masked Coupler CM-1 | 0.010 |
| Dye 1 | 0.003 |
| Dye 2 | 0.021 |
| Layer 4 (Red-Sensitive Medium Sensitivity Layer) | |
| Silver Iodobromide Emulsion B (AgI 6% moles, average diameter 0.60 $\mu$m) | 0.720 |
| Gelatin | 1.060 |
| Cyan Coupler C-1 | 0.407 |
| Dir Coupler D-1 | 0.014 |
| Masked Cyan Coupler CM-1 | 0.067 |
| Layer 5 (Red-Sensitive High Sensitivity Layer) | |
| Silver Iodobromide Emulsion C (AgI 12% moles, average diameter 1.09 $\mu$m) | 1.600 |

-continued

| | |
|---|---|
| Gelatin | 1.050 |
| Cyan coupler C-1 | 0.330 |
| DIR Coupler D-2 | 0.003 |
| Masked Cyan Coupler CM-1 | 0.016 |
| Layer 6 (Interlayer) | |
| Gelatin | 1.250 |
| Compound-1 | 0.056 |
| Hardener H-1 | 0.073 |
| Layer 7 (Green-Sensitive Low Sensitivity Layer) | |
| Silver Iodobromide Emulsion A (AgI 2.5% moles, average diameter 0.4 $\mu$m) | 0.310 |
| Gelatin | 1.250 |
| Magenta Coupler I-1 | 0.152 |
| Masked Magenta Coupler MM-1 | 0.104 |
| Compound-1 | 0.080 |
| Layer 8 (Green-Sensitive Medium Sensitivity Layer) | |
| Silver Iodobromide Emulsion B (AgI 6.0% moles, average diameter 0.60 $\mu$m | 0.740 |
| Gelatin | 1.310 |
| Magenta Coupler I-1 | 0.167 |
| DIR Coupler D-1 | 0.024 |
| Masked Magenta Coupler MM-1 | 0.095 |
| Compound-1 | 0.010 |
| Layer 9 (Green-Sensitive High Sensitivity Layer) | |
| Silver Iodobromide Emulsion C (AgI 12.0% moles, average diameter 1.10 $\mu$m) | 1.400 |
| Gelatin | 1.710 |
| Magenta Coupler I-1 | 0.215 |
| DIR Coupler D-2 | 0.016 |
| Masked Magenta Coupler MM-1 | 0.072 |
| Layer 10 (Interlayer) | |
| gelatin | 1.050 |
| Layer 11 (Yellow Filter Layer) | |
| Gelatin | 1.020 |
| Yellow Colloidal Silver | 0.055 |
| Hardener H-1 | 0.064 |
| Layer 12 (Blue-Sensitive Low Sensitivity Emulsion Layer) | |
| Silver Iodobromide Emulsion A (AgI 2.5% moles, average diameter 0.22 $\mu$m) | 0.210 |
| Silver Iodobromide Emulsion B (AgI 6.0% moles, average diameter 0.60 $\mu$m) | 0.230 |
| Gelatin | 1.810 |
| Yellow Coupler Y-1 | 0.822 |
| DIR Coupler D-2 | 0.049 |
| Layer 13 (Blue-Sensitive High Sensitivity Emulsion Layer) | |
| Silver Iodobromide Emulsion C (AgI 12% moles, average diameter 1.10 $\mu$m) | 0.580 |
| Gelatin | 1.320 |
| Yellow Coupler Y-1 | 0.356 |
| Cyan coupler C-2 | 0.022 |
| DIR Coupler D-2 | 0.038 |
| Layer 14 (1st Protective Layer) | |
| Unsensitized Silver bromide Lippmann Emulsion | 0.200 |
| Gelatin | 1.120 |
| UV-1 | 0.095 |
| UV-2 | 0.095 |
| Compound-2 | 0.131 |
| Layer 15 (2nd Protective Layer) | |
| Gelatin | 0.085 |
| Polymethylmethacrylate Matting Particles | 0.013 |
| (Ethylmethacrylate-Methacylic Acid) Copolymer Matting Agent | 0.172 |
| Hardener H-2 | 0.374 |

Another multilayer color photographic material was then prepared (Comparison Sample 102) with the same layer formulation of Sample 101 except that magenta masking coupler MM-1 of the 7th, $8^{th}$ and $9^{th}$ layers was replaced by magenta masking coupler MM-2 at equimolar level. Another multilayer color photographic material (Comparison Sample 103) was prepared like Sample 101, with the exception that magenta masking coupler MM-1 of the 7th, $8^{th}$ and $9^{th}$ layers was replaced by magenta masking coupler MM-3 at equimolar level. Another multilayer color photographic material (Invention Sample 104) was prepared like Sample 101, with the exception that magenta masking coupler MM-1 of the 7th, $8^{th}$ and $9^{th}$ layers was replaced by magenta masking coupler III-1 of the present invention at equimolar level.

Samples of each film were exposed to a white light source having a color temperature of 5,500° K. All exposed samples were developed with a standard C41 processing, as described in British Journal of Photography, 12 July 1974, pages 597–598. The speeds of the green-sensitive, obtained at a density of 0.2 above minimum density as well as Dmin, Dmax and contrast are reported in the following Table I.

TABLE I

| MAGENTA | Dmin | Dmax | Speed | Contrast |
|---|---|---|---|---|
| 101 (Comp) | 0.72 | 2.69 | 2.30 | 0.51 |
| 102 (Comp) | 0.75 | 2.70 | 2.22 | 0.55 |
| 103 (Comp) | 0.68 | 2.65 | 2.28 | 0.51 |
| 104 (Inv) | 0.77 | 2.72 | 2.44 | 0.65 |

Table I clearly shows good results for Sample 104, containing the magenta coupler I-1 and the magenta colored coupler III-1 of the present invention, having surprisingly higher speed and contrast than Comparison Samples 101–103, containing the magenta coupler I-1 of the present invention but a magenta colored coupler not belonging to general formual (III) of the present invention.

The formulas of the compunds used to prepare the above mentioned samples are showed hereinbelow.

Dye 1:

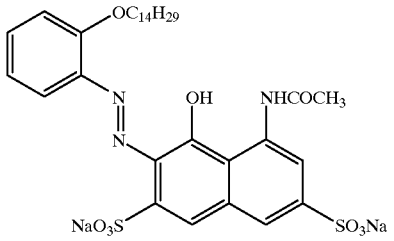

Dye 2:

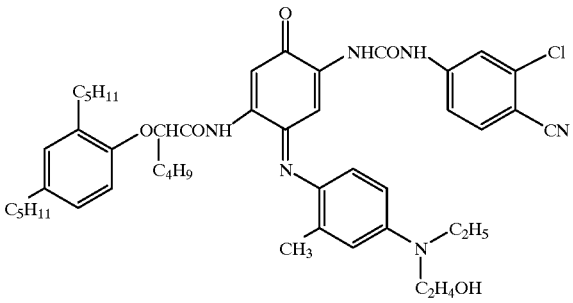

-continued

Compound 1:

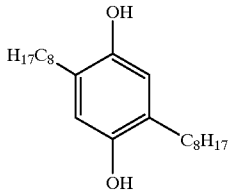

UV-1:

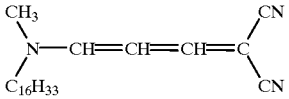

UV-2:

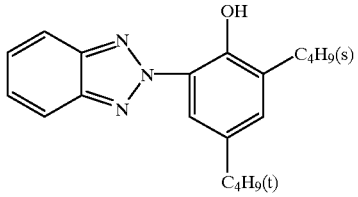

Cyan Coupler C-1:

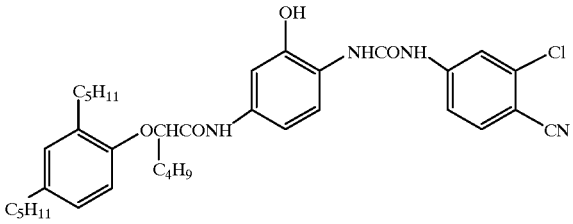

Cyan Coupler C-2:

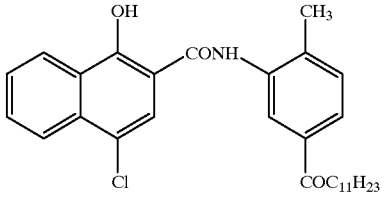

Cyan Masked Coupler CM-1:

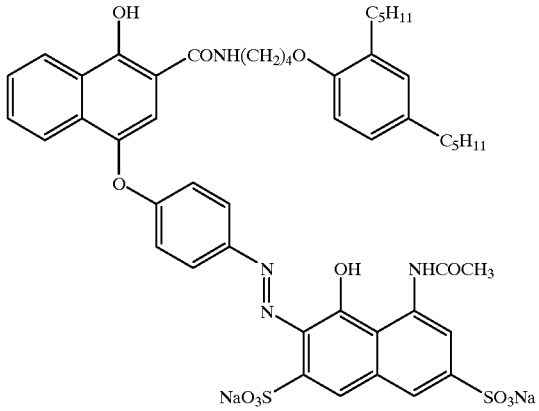

-continued
DIR Coupler D-1:
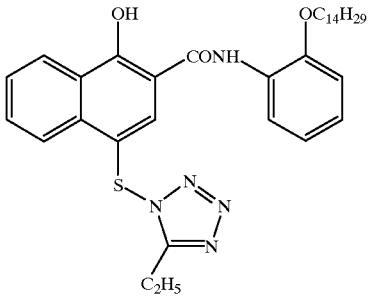
Hardener H-1:
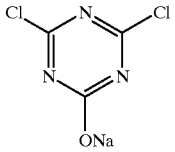
DIR Coupler D-2:
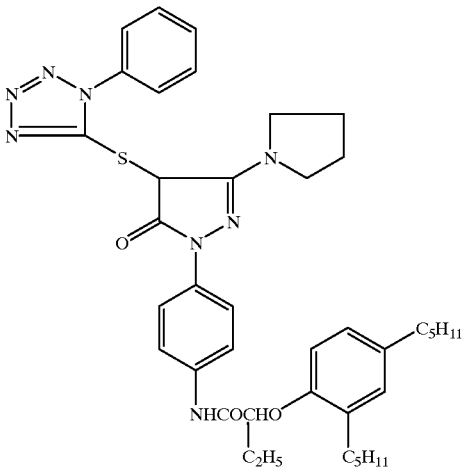
Masked Megenta Coupler MM-1:
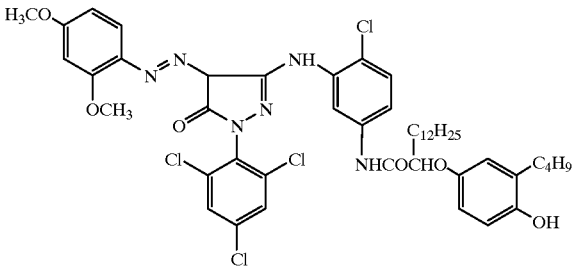
-continued
Masked Megenta MM-2:
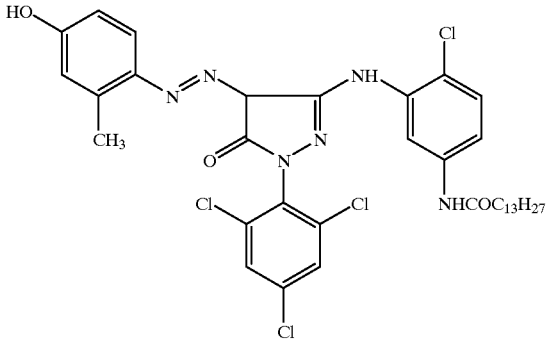
Masked Megenta Coupler MM-3:
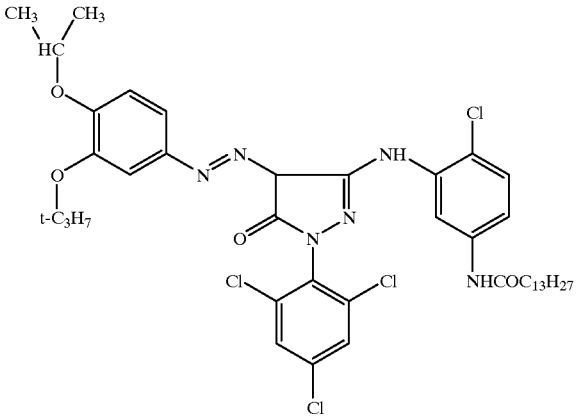
Yellow Coupler Y-1:
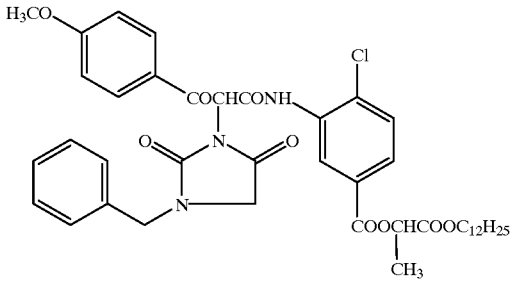
Compound-2:
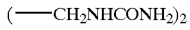
Hardener H-2:
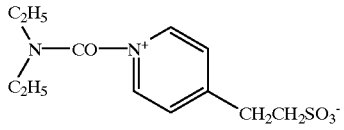

What is claimed is:

1. A light-sensitive silver halide multilayer color photographic element having a support base and coated thereon blue-, green- and red-sensitive silver halide emulsion layers respectively associated with non-diffusing yellow, magenta and cyan dye-forming couplers, wherein at least one green-sensitive layer contains a 2-equivalent 3-anilino-4-phenylthio-5-pyrazolone magenta coupler and a 4-(4-hydroxy-phenylazo)-5-pyrazolone colored magenta coupler.

2. A light-sensitive silver halide multilayer color photographic element of claim 1, wherein the 2-equivalent 3-anilino-4-phenylthio-5-pyrazolone magenta coupler is represented by the formula:

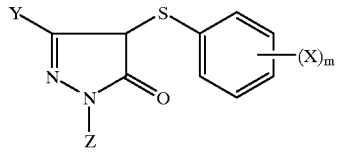

wherein Z represents a phenyl group substituted with one or more substituents selected from halogen atoms, alkyl groups, alkoxy groups, alkoxycarbonyl groups, or cyano groups, Y represents an anilino group, X represents hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, m represents an integer of from 1 to 5 and X may be the same or different when m is 2 or more.

3. A light-sensitive silver halide multilayer color photographic element of claim 1, wherein the 2-equivalent 3-anilino-4-phenylthio-5-pyrazolone magenta coupler is represented by the formula

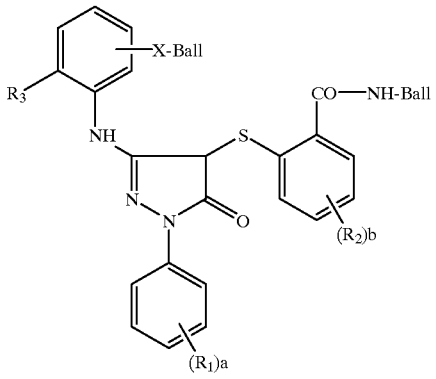

wherein a represents an integer from 0 to 3, b represents an integer from 0 to 2, $R_1$ and $R_2$ are each individually hydrogen, alkyl, alkoxy, halogen, aryl, aryloxy, acylamino, sulfonamido, sulfamoyl, carbamoyl, arylsulfonyl, aryloxycarbonyl, alkoxycarbonyl, alkoxysulfonyl, aryloxysulfonyl, alkylureido, arylureido, nitro, cyano, hydroxyl or carboxy group, $R_3$ is halogen atom, alkyl group or aryl group, X is a direct link or a linking group, and Ball is a ballasting group of such size and configuration as to render a group to which is attached non-diffusible in photographic coatings.

4. A light-sensitive silver halide multilayer color photographic element of claim 3, wherein $R_1$ are chlorine atoms, a is 3, and the chlorine atoms are attached to the carbon atoms in position 2, 4 and 6 with respect to the carbon atom attached to the nitrogen atom.

5. A light-sensitive silver halide multilayer color photographic element of claim 3, wherein $R_3$ is a chlorine atom.

6. A light-sensitive silver halide multilayer color photographic element of claim 1, wherein the 2-equivalent 3-anilino-4-phenylthio-5-pyrazolone magenta coupler is selected within the group of:

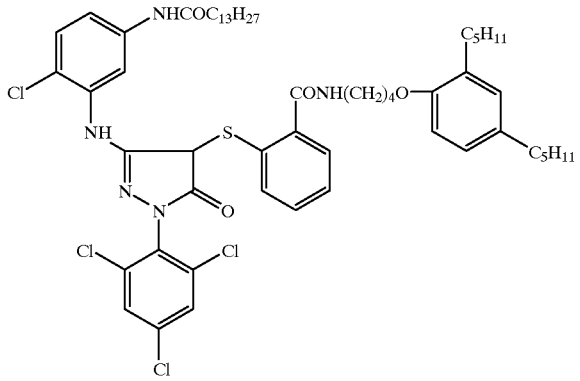

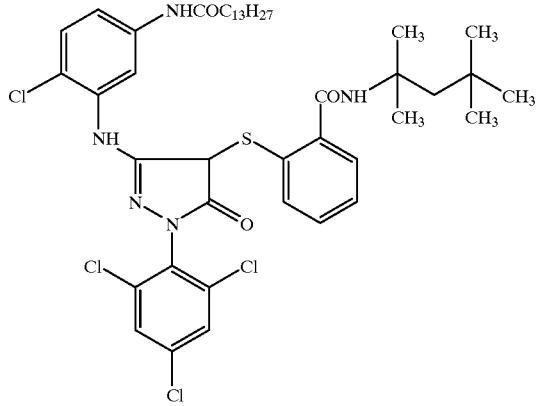

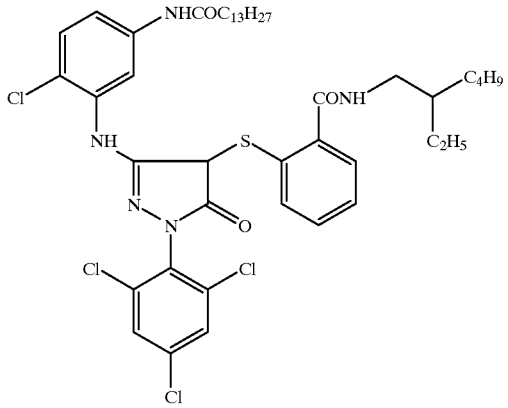

-continued

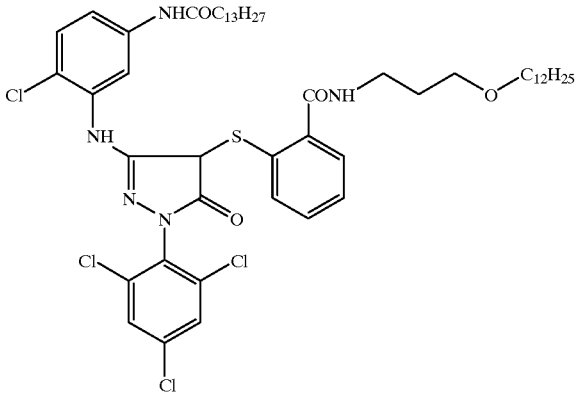

7. A light-sensitive silver halide multilayer color photographic element of claim 1, wherein 4-(4-hydroxyphenylazo)-5-pyrazolone colored magenta coupler is represented by the formula:

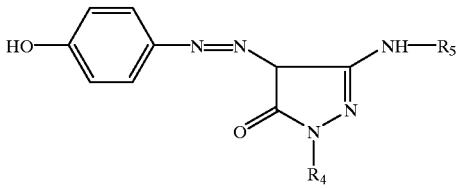

wherein $R_4$ represents an aryl group or a heterocyclic group, and $R_5$ represents a phenyl group.

8. A light-sensitive silver halide multilayer color photographic element of claim 1, wherein the 4-(4-hydroxyphenylazo)-5-pyrazolone colored magenta coupler is selected within the group of:

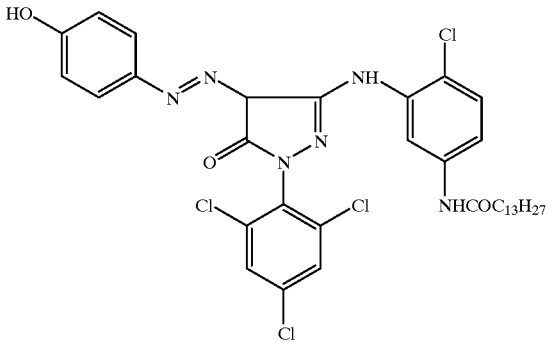

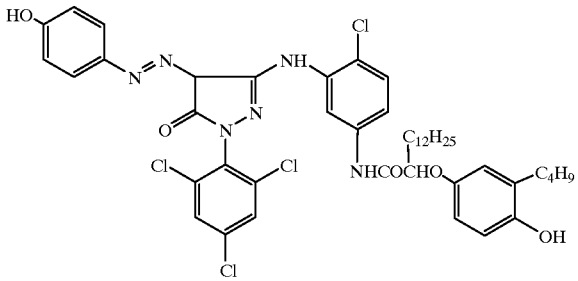

-continued

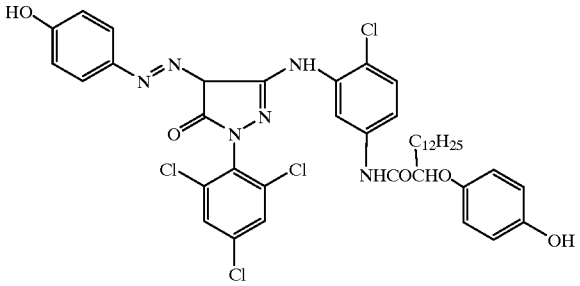

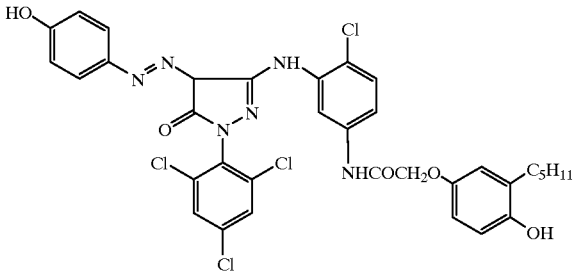

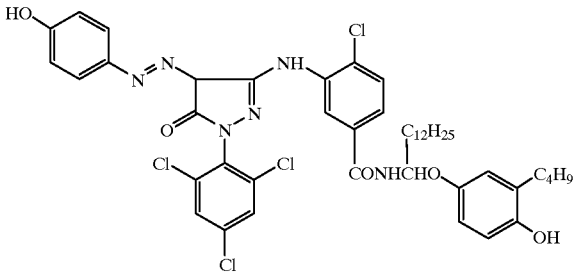

9. A light-sensitive silver halide multilayer color photographic element of claim 1, wherein the total amount of 2-equivalent 3-anilino-4-phenylthio-5-pyrazolone magenta coupler is in the range from about 100 to about 1000 mg/m$^2$ of the photographic element.

10. A light-sensitive silver halide multilayer color photographic element of claim 1, wherein the total amount of 4-(4-hydroxy-phenylazo)-5-pyrazolone colored magenta coupler is in the range from about 10 to about 500 mg/m$^2$ of the photographic element.

* * * * *